US005345037A

United States Patent [19]

Nordelius

[11] Patent Number: 5,345,037

[45] Date of Patent: Sep. 6, 1994

[54] ACOUSTIC DRUM TRANSMITTER AND A HOLDER THEREFOR

[75] Inventor: Hans Nordelius, Stockholm, Sweden

[73] Assignee: Clavia Digital Musical Instruments AB, Sweden

[21] Appl. No.: 58,038

[22] Filed: May 3, 1993

Related U.S. Application Data

[63] Continuation of Ser. No. 820,775, Jan. 15, 1992, abandoned.

[30] Foreign Application Priority Data

Nov. 15, 1991 [SE] Sweden ..... 9103383
Nov. 15, 1991 [SE] Sweden ..... 9103384

[51] Int. Cl.[5] ..... G10H 3/14
[52] U.S. Cl. ..... 84/730; 84/743
[58] Field of Search ..... 84/723, 730, 733, 734, 84/742, 743, DIG. 12, DIG. 24

[56] References Cited

U.S. PATENT DOCUMENTS 3,725,561 4/1973 Paul .
4,837,836 6/1989 Barcus .
5,036,742 8/1991 Youakim .
5,134,920 8/1992 Clark ..... 84/730

FOREIGN PATENT DOCUMENTS 0248528 12/1987 European Pat. Off. .
WO90/03639 4/1990 PCT Int'l Appl. .

*Primary Examiner*—Shoop, Jr. William M.
*Assistant Examiner*—Jeffrey W. Donels
*Attorney, Agent, or Firm*—Banner, Birch, McKie & Beckett

[57] ABSTRACT

A transmitter (2) is arranged on an acoustic drum to transform wave motions generated by hits on the drumhead (10) in electrical signals. The transmitter (2) comprises a vibration sensitive body (8) designed to be elastically forced against the drumhead (10). According to a first aspect on the invention the vibration sensitive body (8) has got an oblong shape (L:W) for detection of wave motions of a predetermined direction and within a predetermined frequency range. Another aspect on the invention is to avoid the risk of mechanical damages to the vibration sensitive body (8) as well as to emphasize the ability to detect the wave motions in the drumhead (10). This is implemented by a holder (3) being fixable to the edge (5) of the drum rim (6). The holder (3) includes an elastic spring device (12, 13) carrying the vibration sensitive body (8). Within the L-shaped holder (3) there are conductors (15) electrically connecting the vibration sensitive body (8) with a connector (16) incorporated with the holder (3).

22 Claims, 2 Drawing Sheets

ACOUSTIC DRUM TRANSMITTER AND A HOLDER THEREFOR

Figure 1:
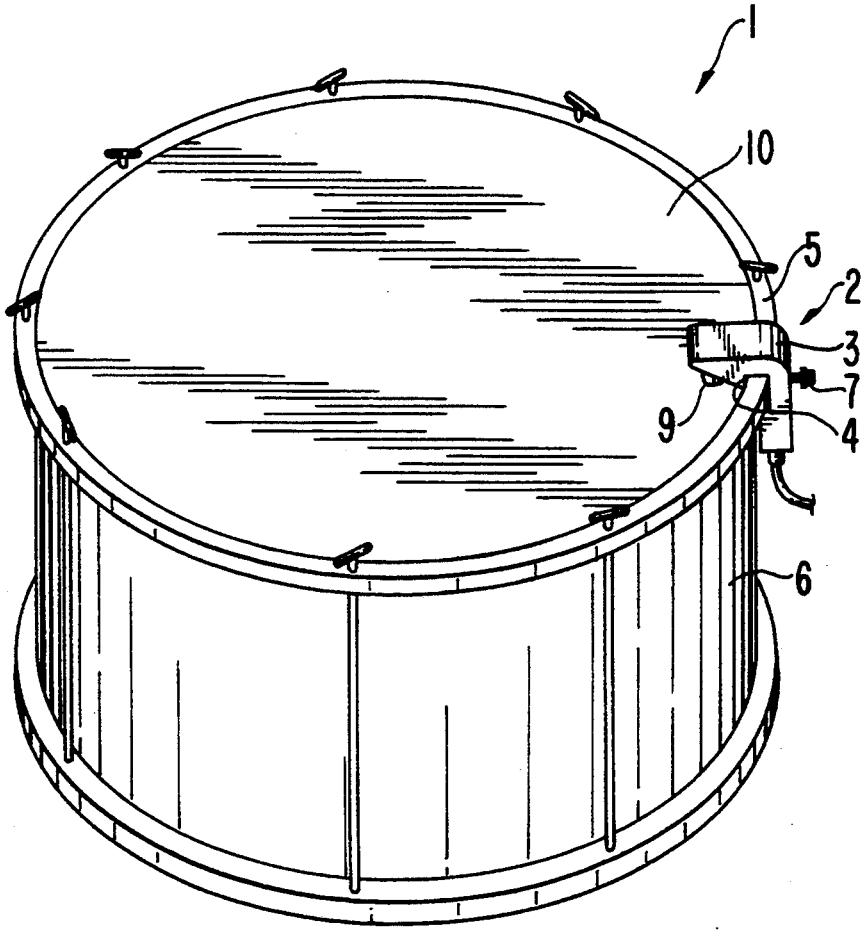

This application is a continuation of application Ser. No. 07/820,775, filed Jan. 15, 1992 now abandoned.

TECHNICAL AREA

The disclosed invention is directed to a transmitter for obtaining an electrical signal from an acoustic drum. The transmitter comprises a vibration sensitive body which is designed to bear against the drumhead the wave motion of which is intended to be detected and picked up.

BACKGROUND OF THE INVENTION

Today it is common knowledge to arrange transmitters or microphones on the body of an instrument in order to obtain an electrical signal which can be utilized for triggering of synthesizers or for converting of MIDI (Musical Instrument Digital Interface) information.

Known transmitters for acoustic drums usually comprises a piezo electrical ceramic body being fastened to the drumhead by double-faced tape. The ceramic body is of a relative small thickness and generally has a circular area. The commonly used transmitters detect waves of the drumhead regardless of their direction. This gives rise to problems among others because hits on the drumhead at the center of the drum result in a weak signal amplitude while hits made close to the rim of the drum result in a strong signal amplitude. This is a real source to false signals from the transmitter and has been the object of electronic correction in the subsequent amplification circuit. Certainly a large part of the false signals have been eliminated in this way but it has been on the account of the transmitter sensitivity and of the frequency range of the generated signal.

To the utmost possible extent avoid hitting the transmitter body by drum stick the body is placed in close proximity to the rim of the drum. Up to now this has also implied shortest possible wiring to the required connector device, which hitherto has been in form of a separate unit below the drum rim edge.

By the transmitter body area design and by the decentralized positioning of on the drumhead the transmitter has been sensitive to all the different wave motions being the result from a hit on the drumhead. Furthermore such a known transitter is especially receptive to decentralized hits and the wave motions generated thereby in the drumhead.

SUMMARY OF THE INVENTION

One aspect of the present invention is to avoid the drawbacks emanating from the source of false signals mentioned above. According to the Invention this is obtained by designing the transmitter with a vibration sensitive body elastically to be pressed against the drumhead in order to detect wave motions of mainly one predetermined direction only. Suitably it is also arranged to detect wave motions within a predetermined frequency range.

From the aspect to obtain a maximum of pointed sensitivity the vibration sensitive body of the transmitter ought to have smallest possible width and an infinite length. However, the last mentioned qualification, i.e. infinite length, would make the body hypersensible to long wavelengths i.e. low frequencies. Therefore it is necessary to adjust the physical length of the body to the wavelength/frequency giving the limit of the transmitter sensitivity. An important requirement on transmitters for acoustic drums is to eliminate/suppress long wavelengths.

A preferred embodiment of the inventive transmitter includes a vibration sensitive body having a mainly oblong area, preferably with a width length ratio of 1:2. It may be obtained e.g. by restricting the total body area by means of stiffening elements to give it a rectangular shape. However, most advantageous is just to make the total body area in the specific rectangular shape.

An optimal embodiment of the vibration sensitive body of the transmitter is obtained by tapering the rectangular area to show a pointed shape, the point of which being directed to the center of the waves to be recognized while the base of the area will be used for applying the electrical conductors.

Another aspect of the present invention is to avoid the risk of mechanically damaging the vibration sensitive body as well as emphasize the ability to detect wave motions in the drumhead. This is obtained by a holder within which the vibration sensitive body is carried under a cover formed by the holder, The cover protrudes above the drumhead being mainly plan parallel thereto. The vibration sensitive body is pressed against the drumhead by the holder cover in such a way that wave motions of mainly a predetermined direction are detected.

A preferred embodiment of the inventive holder includes means for attaching the holder to the rim of the acoustic drum. Besides the vibration sensitive body the holder also contains an electrical connector and conductors coupling the transmitter to the connector, The holder will be a sturdy mechanical shield for the transmitter and the conductors connected thereto.

Moreover several other advantages are obtained. E.g. a well defined unit is obtained which by simple measures can be attached to the drum, a much important advantage when changing drumhead. Furthermore a well defined direction of the vibration sensitive body is obtained. Another very important advantage is the stability received through the fixing of the transmitter relative to the drumhead and the elimination of risking that the transmitter will come loose while playing the drum (which up to now has been a big problem by transmitters known per se).

A PREFERRED EMBODIMENT

The inventive transmitter and holder will be described in more detail below In connection with a preferred embodiment shown in the accompanying drawings, where FIG. 1 is a perspective view of an acoustic drum with a transmitter attached according to the invention.

Figure 2:
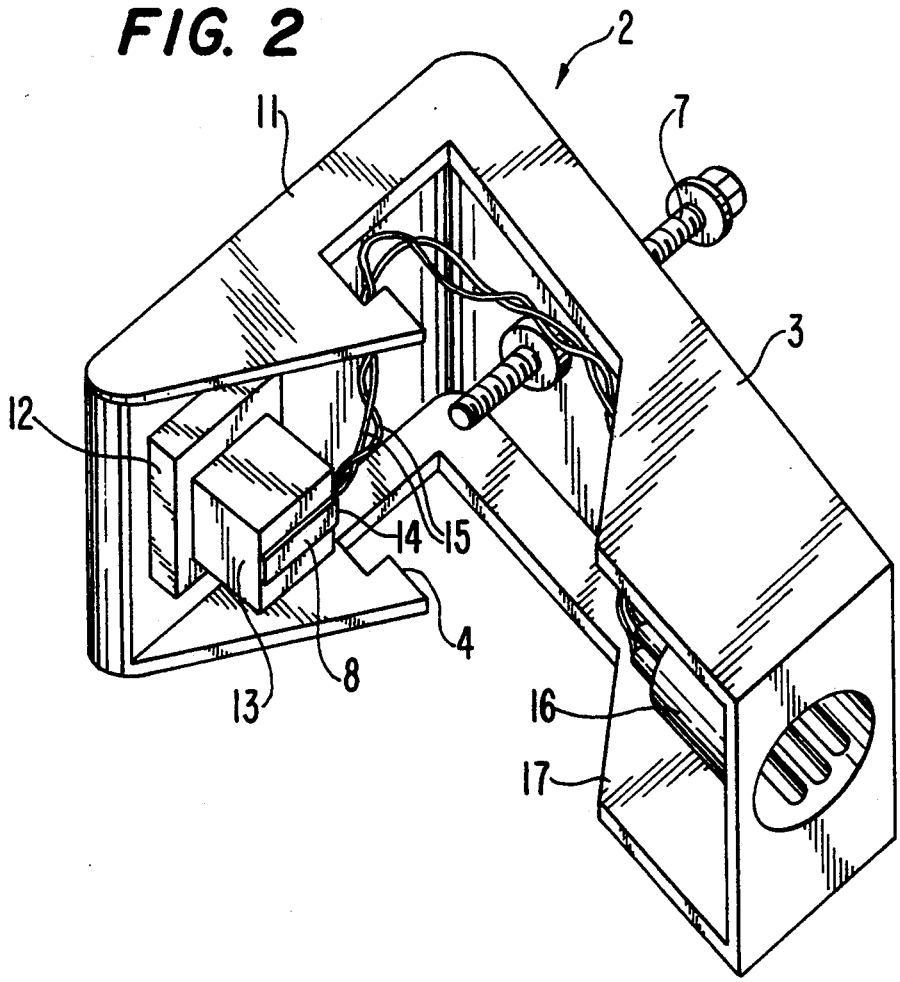
Figure 3:
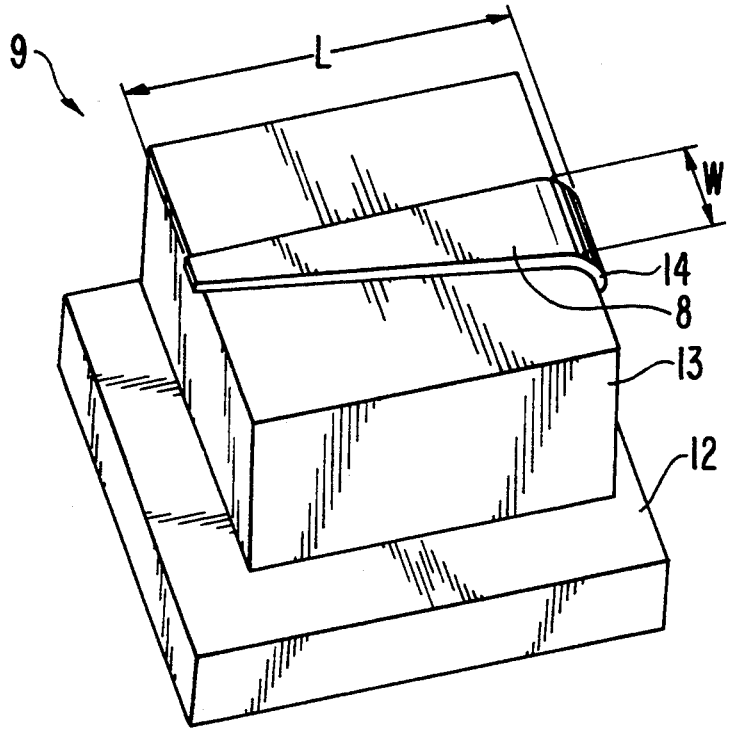

FIG. 2 is a perspective view of the transmitter according to FIG. 1 shown in an unattached situation, and FIG. 3 is an embodiment of the vibration sensitive body of the transmitter.

In FIG. 1 an acoustic drum 1 is shown with an attached transmitter 2. The transmitter 2 comprises a holder 3 having a hook 4 grasping the edge 5 on the rim 6 of the drum 1. The holder 3 is fixed by a screw 7 tightened against the rim 6. The transmitter 2 includes a vibration sensitive body 8 (FIGS. 2 and 3) being carried by a spring device 9 which forces the body 8 against the head 10 of the drum 1.

FIG. 2 shows the embodiment of the inventive body 8 at present being the most preferable one. The holder 3 has an inverted L-shape that creates a house type cover 11 protrudes above and mainly in a plane parallel to the drumhead 10 (FIG. 1). At the surface of the cover 11 facing the drumhead 10 the vibration sensitive body 8 is carried by the spring device 9. In the preferred embodiment the device 9 consists of a spacer 12, preferably of hard rubber, glued to the inside surface of the cover 11 in turn carrying a pad 13, preferably made of plastic foam, onto which the downwards turned surface of the vibration sensitive body 8 is fixed. The affixing is preferably made through gluing.

At its base 14 the vibration sensitive body 8 is connected to electrical conductors 15 going inside the holder 3 downwards to a connector device 16 at the end of the leg 17 of the holder 3.

The cover 11 and the leg 17 of the holder 3 form the hook 4 the shape of which being adapted to the shape of the edge 5 of the rim 6 of the drum 1. Through this hook 4 and screw 7 the holder 3 will be firmly attached to the drum 1, whereby the vibration sensitive body 8 safely bears against the drumhead 10.

As is made clear in FIG. 3 the vibration sensitive body 8 has a generally rectangular shape with a length L and a width W. The ratio W:L is at least 1:2. The vibration sensitive body 8 is positioned on the drumhead such that its longitudinal axis is generally perpendicular to the wavefront produced on the drumhead by those waves primarily to be detected as illustrated in FIGS. 1 and 2 wherein the waves primarily to be detected are those emanating from hits made to the center of the drumhead (as discussed above at page 1, lines 20–24, of the specification). Also note that body 8 may be constructed with a taper along its longitudinal axis. In order to obtain maximum beaming effect without loosing sufficient signal strength the body 8 may with advantage be given a somewhat pointed shape, the point then being aligned with the direction to the center of those waves that primarily are to be detected.

The vibration sensitive body 8 is manufactured of a piezo electric ceramic material, piezo electric plastic material or the like.

Though having described a preferred embodyment of the transmitter above in connection with the drawing figures the invention should not be restricted thereto but can involve different modifications without leaving the inventive idea. E.g. the spring device 9 may have different design and the shape of the holder 3 can be adjusted for its purpose.

We claim:

1. A transmitter for obtaining an electrical signal from an acoustic drum, said transmitter comprising a vibration sensitive device resting on the drumhead of said acoustic drum from which wave motions are to be detected, wherein said vibration sensitive device has a substantially oblong shape and wherein the longitudinal axis of said vibration sensitive device is aligned to be generally perpendicular to a wavefront of said wave motions originating from a particular direction on said drumhead.

2. A transmitter according to claim 1, wherein said vibration sensitive device is a bending sensor flexibly and resiliently positioned directly in contact with said drumhead.

3. A transmitter according to claim 1, where said vibration sensitive device is designed to detect waves within a predetermined wavelength range.

4. A transmitter according to claim 1, where said substantially oblong shape of said vibration sensitive device has a width-length ratio of at least 1:2.

5. A transmitter according to claim 1, wherein said oblong shape of said vibration sensitive device is tapered having a point directed towards said wavefront.

6. A transmitter according to claim 1, wherein said vibration sensitive device is positioned on said drumhead such that the wave motions impinging on said vibration sensitive device from said particular direction on said drum cause a higher amplitude signal to be induced in said vibration sensitive device than do wave motions impinging on said vibration sensitive device from other directions.

7. A transmitter according to claim 1, wherein said vibration sensitive device is manufactured of piezo electric ceramic material.

8. A transmitter according to claim 1, wherein said vibration sensitive device is manufactured of piezo electric plastic material.

9. A transmitter according to claim 1, wherein said vibration sensitive device is arranged on said acoustic drum by holding means comprising:

a spring device attached to said vibration sensitive device for positioning said vibration sensitive device flexibly and resiliently on said drumhead;

electrical conductor means coupled to said vibration sensitive device for transmitting an electrical signal from said vibration sensitive device;

connector means coupled to said electrical conductor means to allow transmission of said electrical signal from said transmitter; and fastening means for fastening said holding means to the rim of said acoustic drum.

10. A transmitter according to claim 9, wherein said spring device includes a spacer and a pad of a softer material than the material of said spacer such that said vibration sensitive device is attached to the surface of said pad.

11. A transmitter according to claim 10, wherein said pad is made of a plastic foam.

12. A transmitter according to claim 9, wherein said holding means has a substantially L-shape such that a top leg of said holding means form a cover protruding above said drumhead in a plane substantially parallel to said drumhead, and a bottom leg of said holding means is arranged adjacent to said rim of said acoustic drum and attached thereto by said fastening means.

13. A transmitter according to claim 12, wherein said spring device is arranged on the surface of said cover facing said drumhead.

14. A transmitter according to claim 12, wherein said top leg and said bottom leg form a hook having a shape formed to correspond to the shape of the edge of said rim of said acoustic drum.

15. A transmitter according to claim 12, wherein said electrical conductor means and said connector means are positioned within said holding means, said connector means positioned within said bottom leg of said holding means.

16. A transmitter for obtaining an electrical signal from an acoustic drum, said transmitter comprising a vibration sensitive device resting on the drumhead of said acoustic drum and arranged on said acoustic drum by holding means comprising:

a spring device attached to said vibration sensitive device for positioning and vibration sensitive device flexibility and resiliently on said drumhead;

electrical conductor means coupled to said vibration sensitive device for transmitting an electrical signal from said vibration sensitive device;

connector means coupled to said electrical conductor means to allow transmission of said electrical signal from said transmitter; and fastening means for fastening said holding means to the rim of said acoustic drum.

17. A transmitter according to claim 16, wherein said spring device includes a spacer and a pad of a softer material than the material of said spacer such that said vibration sensitive device is attached to the surface of said pad.

18. A transmitter according to claim 16, wherein said pad is made of plastic foam.

19. A transmitter according to claim 16, wherein said holding means has a substantially L-shape such that a top leg of said holding means forms a cover protruding above said drumhead in a plane substantially parallel to said drumhead, and a bottom leg of said holding means is arranged adjacent to said rim of said acoustic drum and attached thereto by said fastening means.

20. A transmitter according to claim 19, wherein said spring device is arranged on the surface of said cover facing said drumhead.

21. A transmitter according to claim 19, wherein said top leg and said bottom leg form a hook having a shape adapted to fit the shape of the edge of said rim of said acoustic drum.

22. A transmitter according to claim 19, wherein said electrical conductor means and said connector means are positioned within said holding means, said connector means positioned within said bottom leg of said holding means.

* * * * *

UNITED STATES PATENT AND TRADEMARK OFFICE

CERTIFICATE OF CORRECTION

PATENT NO. : 5,345,037
DATED : September 6, 1994
INVENTOR(S) : Hans Nordelius

It is certified that error appears in the above-identified patent and that said Letters Patent is hereby corrected as shown below:

Column 4,
Line 67, "and" has been replaced with -- said --.
Line 68, "flexibility" has been replaced with -- flexibly --.

Signed and Sealed this

Seventeenth Day of June, 2003

JAMES E. ROGAN
*Director of the United States Patent and Trademark Office*